United States Patent [19]

Perron

[11] Patent Number: 4,562,836

[45] Date of Patent: Jan. 7, 1986

[54] BREATHING TUBE

[75] Inventor: Roger Perron, Montreal, Canada

[73] Assignee: AMF Incorporated, White Plains, N.Y.

[21] Appl. No.: 440,902

[22] Filed: Nov. 12, 1982

[51] Int. Cl.[4] ..... A62B 7/00

[52] U.S. Cl. ..... 128/201.11

[58] Field of Search ..... 128/201.11, 207.14

[56] References Cited

U.S. PATENT DOCUMENTS

| | | | |
|---|---|---|---|
| 38,505 | 6/1863 | Scholfield | 128/201.11 |
| 690,663 | 1/1902 | Pratt | 128/201.11 |
| 1,122,219 | 12/1914 | Read | 128/201.11 |
| 1,210,939 | 1/1917 | Hilgers | 128/201.11 |
| 1,445,010 | 2/1923 | Feinberg | 128/201.11 |
| 1,539,733 | 5/1925 | Haskell | 128/201.11 |
| 2,317,236 | 4/1943 | Wilen et al. | 128/201.11 |
| 2,753,865 | 7/1956 | Van Der Kogel | 128/201.11 |
| 2,888,010 | 5/1959 | Girden | 128/201.11 |
| 3,603,306 | 9/1971 | Bonin | 128/201.11 |
| 3,814,090 | 6/1974 | Hill | 128/201.11 |
| 4,061,140 | 12/1977 | Saito | 128/201.11 |
| 4,066,077 | 1/1978 | Shamlian | 128/201.11 |
| 4,380,232 | 4/1983 | Doyle | 128/201.11 |

*Primary Examiner*—Henry J. Recla

*Attorney, Agent, or Firm*—David E. Dougherty; Walter R. Pfluger, Jr.

[57] ABSTRACT

A breathing tube for underwater activities comprising an elongated tube having a free end and an opposite mouth-receiving end which is attached to the tube to a users underwater mask. The tube is attached to the mask by a tubular sleeve in free slideable engagement with the tube for relative sliding displacement. The sleeve is connected to the mask. The tube is also provided with a stop for preventing disengagement between the sleeve and the tube.

9 Claims, 2 Drawing Figures

BREATHING TUBE

BACKGROUND OF THE INVENTION

The invention described in this application is described in Disclosure Document No. 089,393, the entire disclosure of which is incorporated herein by reference.

The present invention is concerned with a breathing tube for underwater activities. More particularly, the invention relates to improvements with respect to attachment means used to attach the breathing tube to a user's underwater mask.

One of the problems encountered with breathing tubes is that of their proper fixation in position for use and their disposition when not in use.

Numerous fixation systems have been designed for this purpose. The simplest consists in inserting the breathing tube under the fastening strap of the mask. However, this method proves inconvenient under many circumstances, and does not permit ready removal of the mouthpiece without a risk of displacing the mask as well, thus admitting water into the mask. It is also very uncomfortable to feel the constant pressure exerted on the head by the breathing tube which is pressed against the latter by the strap of the mask.

A second type of fixation consists in providing the tube with a pair of elastic rings joined together by an elastic band to be passed around the strap of the mask. This system is also inconvenient because the mouthpiece is kept fixed to the mask in a position which cannot be easily changed or adjusted, while it is often necessary to remove the mouthpiece from the user's mouth, as is required, for example, in changing from a mouthpiece breathing system to an auto-respirator system. Another drawback is that it tends to pull the hair of the user when he is not wearing a diving hood. The elastic rings generally do not last very long since they are pulled or stretched quite often, particularly when the mouthpiece of the breathing tube is inserted into the mouth or removed therefrom. Moreover, since these rings exert a gripping action on the tube and thus cannot be readily moved therealong for adjustment, the breathing tube is often misheld and/or mispositioned and, as a consequence, the tube undergoes vibration as the user swims and water may be more easily admitted thereinto. If the breathing tube is improperly positioned, the mouthpiece thereof has also a tendency of springing away from the mouth, resulting in inconvenience to the user as well as discomfort.

In some European countries, it has also been proposed to provide breathing tubes with a cord to be worn like a collar, and to fix the breathing tube in operative position to the fastening strap of the mask, whereas when not in use for a long period it may, for example, be placed in the belt. This cord is often in the way and dangerous to be worn around the neck. On the other hand, some divers put their breathing tube under their weight belt which is usually loaded and the tube often slips away. Others put it under the knife holding strap, along their leg; as a consequence, the breathing tube offers resistance to the diver's performance.

SUMMARY OF THE INVENTION

It is therefore an object of this invention to provide a breathing tube having attachment means which eliminate the aforesaid disadvantages of known devices.

It is another object of the invention to provide a breathing tube which, by virtue of its attachment means, may be easily and correctly positioned by the user.

In accordance with the present invention, there is thus provided a breathing tube for underwater activities, comprising an elongated tube having a free end and an opposite mouth-receiving end, and means for attaching the tube to a user's underwater mask. The attachment means comprises a tubular sleeve in free slidable engagement with the tube for relative sliding displacement and means on the sleeve for connecting the sleeve to the mask. The tube is also provided with stop means for preventing disengagement between the sleeve and the tube.

According to a preferred embodiment, the connecting means which serve to connect the sleeve to the mask comprise a pair of spaced-apart rings elastically gripping the sleeve and a link element interconnecting the rings to define with the sleeve a loop for receiving a strap portion of the mask. In order to retain these rings on the sleeve and thus to prevent them from accidentally sliding off the sleeve, such as may occur under strong current conditions, the sleeve is preferably provided at each end thereof with an outwardly extending peripheral flange which acts as a stop.

On the other hand, the sleeve itself is prevented from sliding off the tube at the free end thereof by the provision of stop means which preferably comprise a ring elastically gripping the tube and selectively positionable along a length of the tube intermediate the free end thereof and the sleeve. In this way, it is possible to not only prevent disengagement between the sleeve and the tube at its free end, but also to adjustably limit their relative sliding displacement.

The mouth-receiving end of the tube advantageously has a mouthpiece which is angularly inclined relative to the longitudinal axis of the tube and is forcably pivotable about this axis. The tube preferably includes two straight portions joined by an intermediate arcuate portion, the straight and arcuate portions lying in a common plane and the mouthpiece extending in an oblique plane relative to the common plane.

It has been found quite advantageous to connect the sleeve to a strap portion of the mask at a point rearwardly of the user's ear such that, when the breathing tube is positioned for use by the user and the mouthpiece is brought into the mouth, the tube is caused to slide through the sleeve so as to occupy an operative position whereat the arcuate portion of the tube extends substantially adjacent the ear lobe and in close proximity to the head and the straight portion adjacent the free end of the tube extends substantially upwardly forwardly. In other words, when in the operative position, the tube follows the natural curvature of the head, thus eliminating or at least reducing resistance to the water environment.

Since the tube as it is being brought into the operative position is allowed to freely slide through the sleeve connected to the strap portion of the mask, mispositioning of the tube and accompanying hair pulling are eliminated, as well as the tendency of the mouthpiece to spring away from the mouth. In addition, since the sleeve is connected to the strap portion at a point rearwardly of the user's ear and thus holds the tube not only in close proximity to the head but also at a point remote from the other point of fixation at the mouth, the tube is firmly held in a stable manner, thereby eliminating undesirable vibrations of the tube during swimming.

BRIEF DESCRIPTION OF THE DRAWINGS

Further features and advantages of the invention will become apparent from the following detailed description of a preferred embodiment thereof, as illustrated by way of example in the accompanying drawings, wherein.

DETAILED DESCRIPTION OF PREFERRED EMBODIMENTS

Figure 1:
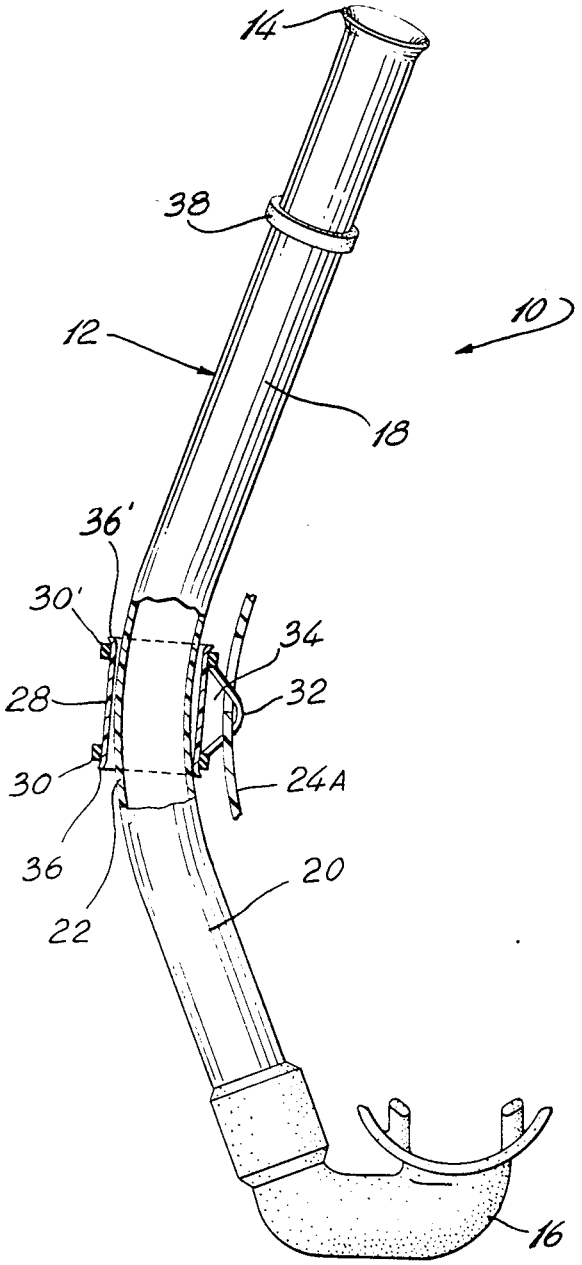
FIG. 1 is a part-section side view of a breathing tube according to the invention.
Figure 2:
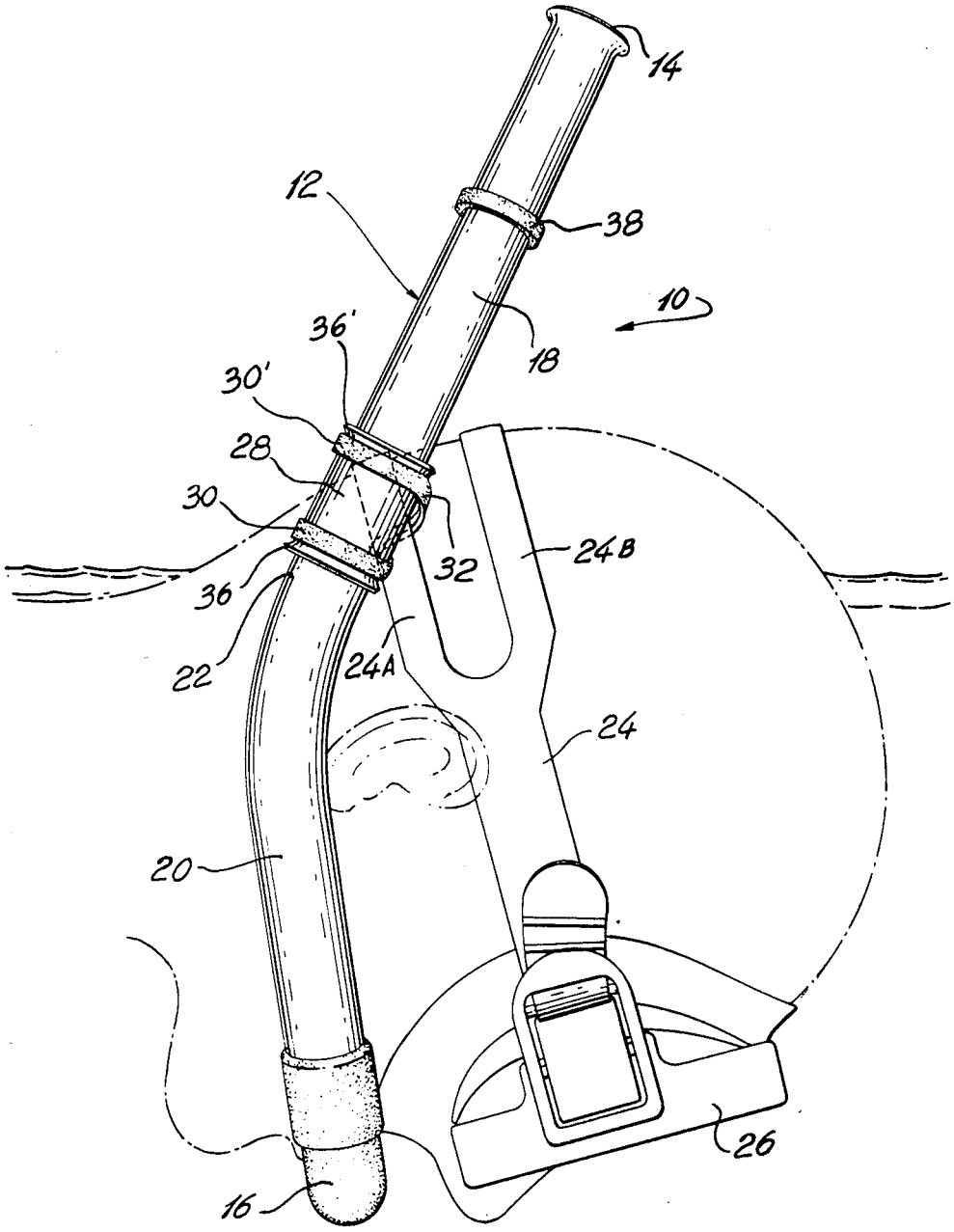
FIG. 2 is another side view showing the breathing tube of FIG. 1 in operative position

Referring to the drawings, there is shown a breathing tube generally designated by reference numeral 10 and comprising an elongated tube 12 provided with an outwardly extending peripheral flange 14 at its free end and a mouthpiece 16 at the opposite end. The tube 12 includes two straight portions 18 and 20 joined by an intermediate arcuate portion 22, the straight and arcuate tube portions lying in a common plane. The mouthpiece 16 which is angularly inclined relative to the longitudinal axis of the tube portion 20 is mounted so as to be forcably pivotable about such axis for adjustment and to thus properly fit the user's mouth. The mouthpiece is preferably adjusted so as to extend in an oblique plane relative to the common plane defined by the straight tube portions 18 and 20 and the arcuate tube portion 22, as best shown in FIG. 2. It is preferably made of silicone which is a smooth material and prevents the teeth enamel to wear off; clear silicone is usually of better quality. The mouthpiece 16 could also of course be integrally molded with the tube 12.

The tube 12 is attached to a strap portion 24A of the user's underwater mask 26 shown in FIG. 2, by means of a short tubular sleeve 28 which has a length of approximately 3 inches and is in free slidable engagement with the tube. The sleeve 28 is connected to the strap portion 24A by a pair of spaced-apart elastic rings 30 and 30' which elastically grip the sleeve and are interconnected by the elastic band 32 to define with the sleeve 28 a loop 34 for receiving the strap portion 24A. In order to prevent the elastic rings 30 and 30' from accidentally sliding off the sleeve 28, the sleeve is provided at the ends thereof with peripheral flanges 36 and 36' which act as stops to retain the rings on the sleeve.

Disengagement between the tube 12 and the sleeve 28, on the other hand, is prevented by the provision of stop means on the tube. In this respect, the flange 14 and the mouthpiece 16 may each serve as a stop to prevent the sleeve 28 from sliding off the tube 12 at either end thereof. However, it is preferred to use an elastic stop ring 38 which elastically grips the tube 12 and is selectively positionable along the straight tube portion 18 between the sleeve 28 and the free end of the tube 12 so as to not only prevent disengagement between the sleeve and the tube at its free end, but also to adjustably limit their relative sliding displacement and to thus avoid unnecessary displacement of the sleeve all the way to the free end of the tube. In addition, since the stop ring 38 prevents the sleeve 28 from reaching the free end of the tube and therefore the flange 36' of the sleeve from abutting against the flange 14 of the tube, the elastic ring 30' is also prevented from accidentally sliding off the tube at that end by being forced over the flange 36' as well as the flange 14 under strong current conditions, should these two flanges have substantially the same outer diameter.

As shown in FIG. 2 which illustrates the breathing tube 10 in operative position, the sleeve 28 is connected to the lower strap portion 24A of the user's mask 26 having a double fastening strap 24 with lower and upper strap portions 24A and 24B, at a point rearwardly of the user's ear. Thus, when the breathing tube 10 is positioned for use by the user and the mouthpiece 16 is brought into the user's mouth, the tube 12 slides up through the sleeve 28 to occupy the operative position shown, whereat the arcuate tube portion 22 extends substantially adjacent the ear lobe and in close proximity to the head and the straight tube portion 18 extends substantially upwardly forwardly. In other words, in the operative position, the tube 12 follows the natural curvature of the head, thereby eliminating or at least reducing resistance to the water environment.

On the other hand, when the mouthpiece 16 is removed from the user's mouth, the tube 12 slides down through the sleeve 28 until the stop ring 38 abuts the sleeve, so as to occupy an inoperative position whereat the mouthpiece 16 and adjacent tube portion 20 lie adjacent the frontal part of the neck. In this position, the breathing tube 10 no longer encumbers the user's face, but may be quickly restored to the operative position by simply sliding the tube up until the mouthpiece is again in place.

As is apparent, since the tube 12 when it is being brought into the operative position is allowed to freely slide through the sleeve 28 connected to the strap portion 24A of the mask 26, mispositioning of the tube and accompanying hair pulling are eliminated, as well as the tendency of the mouthpiece 16 to spring away from the mouth. In addition, since the sleeve 28 is connected to the strap portion 24A at a point rearwardly of the user's ear and thus holds the tube 12 not only in close proximity to the head but also at a point remote from the other point of fixation at the mouth, the tube is firmly held in a stable manner, thereby eliminating undesirable vibrations of the tube during swimming.

I claim:

1. A breathing tube for underwater activities, comprising:

an elongated tube having a free end and an opposite mouth-receiving end;

means for attaching said tube to a user's underwater mask having a strap portion, said attachment means comprising a tubular sleeve in free slideable engagement with said tube for relative sliding displacement and means on said sleeve for connecting said sleeve to said mask, said means comprising a pair of spaced-apart rings elastically gripping said sleeve and a link element interconnecting said rings to define with said sleeve a loop for receiving the strap portion of said mask; and stop means on said tube for preventing disengagement between said sleeve and said tube.

2. A breathing tube as claimed in claim 1, wherein said sleeve is provided at each end thereof with an outwardly extending peripheral flange acting as a stop for retaining each said ring on said sleeve.

3. A breathing tube as claimed in claim 1, wherein said stop means comprise a ring elastically gripping said tube and selectively positionable along a length of said tube intermediate the free end thereof and said sleeve, whereby to adjustably limit the relative sliding displacement between said sleeve and said tube.

4. A breathing tube as claimed in claim 1, wherein said tube is provided at the free end thereof with an outwardly extending peripheral flange acting as said stop means for preventing disengagement between said sleeve and said tube at said free end.

5. A breathing tube for underwater activities, comprising:

an elongated tube having a free end and an opposite mouth-receiving end;

means for attaching said tube to a user's underwater mask having a strap portion, said attachment means comprising a tubular sleeve in free slideable engagement with said tube for relative slideable displacement and means on said sleeve for connecting said sleeve to said mask; and stop means on said tube for preventing disengagement between said sleeve and said tube, said stop means coupling a ring elastically gripping said tube and selectively positionable along a length of said tube intermediate the free end thereof and said sleeve, whereby to adjustably limit the relatively sliding displacement between said sleeve and said tube.

6. A breathing tube as claimed in claim 5, wherein said connecting means comprise a pair of spaced-apart rings elastically gripping said sleeve and a link element interconnecting said rings to define with said sleeve a loop for receiving a strap portion of said mask.

7. A breathing tube as claimed in claim 5, wherein said mouth-receiving end of said tube has a mouthpiece which is angularly inclined relative to the longitudinal axis of said tube and is forcably pivotable about said axis.

8. A breathing tube as claimed in claim 7, wherein said tube includes two straight portions joined by an intermediate arcuate portion, said straight and arcuate portions lying in a common plane, and wherein said mouthpiece extends in an oblique plane relative to said common plane.

9. A breathing tube as claimed in claim 8, wherein when in use by the user, said mouthpiece is engaged in the user's mouth and said sleeve is connected to the strap portion of said mask at a point rearwardly of the user's ear such that said arcuate portion of said tube extends substantially adjacent the ear lobe and in close proximity to the head and the straight portion of said tube adjacent the free end thereof extends substantially upwardly forwardly.

* * * * *